US007597204B2

(12) United States Patent
Jersey et al.

(10) Patent No.: US 7,597,204 B2
(45) **Date of Patent: *Oct. 6, 2009**

(54) COMESTIBLE FLUID RACK AND RAIL APPARATUS AND METHOD

(75) Inventors: Steven T. Jersey, Laguna Niguel, CA (US); William W. Chung, Tujunga, CA (US); Larry D. Broyles, Rowland Heights, CA (US); Michael D. Henry, Martinsville, IN (US); Michael R. Smith, Dana Point, CA (US)

(73) Assignee: SHURflo, LLC, Cypress, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/194,395

(22) Filed: Aug. 19, 2008

(65) Prior Publication Data

US 2009/0045308 A1 Feb. 19, 2009

Related U.S. Application Data

(63) Continuation of application No. 11/788,746, filed on Apr. 19, 2007, now abandoned, which is a continuation of application No. 10/773,110, filed on Feb. 4, 2004, now Pat. No. 7,225,936, which is a continuation-in-part of application No. 10/211,883, filed on Aug. 1, 2002, now Pat. No. 6,834,768.

(51) Int. Cl.
*A47B 43/00* (2006.01)

(52) U.S. Cl. ..... 211/189; 248/149

(58) Field of Classification Search ..... 248/214
See application file for complete search history.

(56) References Cited

U.S. PATENT DOCUMENTS

| | | | | | |
|---|---|---|---|---|---|
| 1,546,576 | A * | 7/1925 | Erwin et al. | ..... | 169/35 |
| 3,879,068 | A * | 4/1975 | Stampfli | ..... | 285/124.5 |
| 4,441,684 | A * | 4/1984 | Credle, Jr. | ..... | 248/674 |
| D357,923 | S * | 5/1995 | Peterson et al. | ..... | D15/9.1 |
| 5,624,167 | A * | 4/1997 | Katz | ..... | 312/223.1 |
| 6,267,268 | B1 * | 7/2001 | Quartarone et al. | ..... | 222/129.1 |
| 6,279,761 | B1 * | 8/2001 | Niewiadomski et al. | . | 211/94.01 |
| 6,435,357 | B1 * | 8/2002 | Lee | ..... | 211/70.6 |
| 6,834,768 | B2 * | 12/2004 | Jersey et al. | ..... | 211/189 |
| 7,225,936 | B2 * | 6/2007 | Jersey et al. | ..... | 211/189 |
| D572,066 | S * | 7/2008 | Swanson | ..... | D6/553 |

* cited by examiner

*Primary Examiner*—J. Allen Shriver, II
*Assistant Examiner*—Bradley H Duckworth
(74) *Attorney, Agent, or Firm*—Greenberg Traurig, LLP

(57) ABSTRACT

Some embodiments of the present invention provide a support adapted to support a comestible fluid container on a comestible fluid container rack, and a container rack having such a support. The support can include a first portion extending from a stretcher of the comestible fluid container rack and a second portion extending substantially laterally from the first portion to support the comestible fluid container thereon.

7 Claims, 7 Drawing Sheets

COMESTIBLE FLUID RACK AND RAIL APPARATUS AND METHOD

RELATED APPLICATIONS

This is a continuation of U.S. patent application Ser. No. 11/788,746 filed on Apr. 19, 2007, now abandoned which is a continuation of U.S. patent application Ser. No. 10/773,110 filed on Feb. 4, 2004, which issued as U.S. Pat. No. 7,225,936 on Jun. 5, 2007, which is a continuation-in-part of U.S. patent application Ser. No. 10/211,883 filed on Aug. 1, 2002 and issued as U.S. Pat. No. 6,834,768, all of which are incorporated herein by reference. The entire disclosures of the prior applications are considered part of the accompanying application and are hereby incorporated therein by reference.

BACKGROUND OF THE INVENTION

Racks of many different configurations are currently available in the food and beverage industry. A number of such racks are employed to store any type of beverage container, including without limitation bottles, boxes, crates, bags, kegs, barrels, and other containers capable of holding fluid. By way of example only, racks are often employed to support syrup containers used in post-mix beverage blending. As is well known in the art, the syrup in such containers is pumped, drained, or otherwise removed from the containers and is often mixed with water or water and gas to yield a post-mix beverage. In those cases where gas is mixed with the syrup, the gases can include carbon dioxide, nitrogen, a combination of carbon dioxide and nitrogen, or any other gas or gas combination.

An example of a fluid container commonly used in the food and beverage industry is the "bag-in-box" container, whereby a comestible fluid (such as a beverage, a syrup or other beverage concentrate, and the like) is contained within a bag enclosed within a box for support. A tap and pump is often employed to extract the comestible fluid from the bag. For example, a tap can be positioned toward the bottom of the bag to enable the fluid to be more completely removed from the bag via a conduit between the tap and pump. In some cases, a metering valve is connected to the bag and pump in order to meter the flow of comestible fluid from the pump or bag. During post-mix beverage blending, a metered supply of syrup is typically mixed with water or with water and a metered amount of gas. Water mixed with comestible fluid from the bag is often chilled to a point within a temperature range in order to promote optimum saturation of gas within the water and syrup mixture.

Currently available comestible fluid container racks are often inadequate for the needs of many users, and even for the process of dispensing comestible fluid from containers on such racks (e.g. in post-mix preparation and in the preparation of other types of beverages). Such comestible fluid container racks can be found in restaurants, bars, concession stands, and the like.

Problems and limitations with conventional comestible fluid container racks include the inability to change the capacity of such racks (whether by changing the size of a rack or by easily and readily adding to the rack), inadequate provisions for mounting or organizing components associated with the dispense of comestible fluid from the containers, and rack designs that are difficult and time-consuming to set up, disassemble, and/or transport. Such components can include pumps, filters, valves, regulators, treatment devices, and conduits to connect such components.

The mounting and arrangement of such components in comestible fluid storage and dispensing systems also presents problems and limitations well known in the art (regardless of whether a rack as described above is employed). By way of example only, these problems and limitations include haphazard and disorganized systems and systems in which systems components are difficult and time-consuming to service, replace, and maintain. In some cases, it can be difficult for a user or other party to even identify which components in the system are associated with which other components.

In light of the problems and limitations of the prior art described above, a need exists for a comestible fluid container rack that is expandable, adjustable, can be relatively easily assembled and disassembled, can be transported, enables a user to mount and/or organize components of a comestible fluid dispensing system thereon, is relatively simple in construction, and is low in cost. Each embodiment of the present invention achieves one or more of these results.

SUMMARY OF THE INVENTION

Some embodiments of the present invention provide a comestible fluid container rack for holding comestible fluid containers from which comestible fluid is dispensed. In some embodiments, the rack is expandable in order to connect additional portions of the rack for added rack capacity. In these and in other embodiments, the rack can be adjustable to meet the needs of various users.

In some embodiments, the comestible fluid container rack includes stackable rack modules. The rack modules allow a user to expand or reduce the amount of available space for comestible fluid containers in the rack by stacking additional rack modules upon one another or by removing one or more rack modules from a stack, respectively. This can enable users to purchase limited numbers of rack modules at a time to more effectively match the needs of the user. In some cases, one or more of the rack modules can be connected to vertically adjacent rack modules (e.g., located above or below the rack module(s)) by one or more couplings. The couplings can enable rack modules to be vertically stacked in a stable manner, and can permit the rack modules to be quickly disassembled, transported, and reassembled as needed. In some embodiments, the rack modules can be disassembled, transported, and/or re-assembled without disturbing comestible fluid containers and comestible fluid dispensing components (such as comestible fluid conduits, valves, pumps, regulators, filters, and the like) on the rack modules.

The comestible fluid container rack of the present invention can have rack modules with telescoping rails enabling a user to adjust the space between vertical supports of the rack. This feature can permit a user to adjust the rack or rack modules to fit comestible fluid containers of different sizes. In some embodiments, each rack module can be independently adjusted to accommodate comestible fluid containers of different sizes. This feature can reduce the need for users to rearrange or relocate comestible fluid containers when containers of different sizes are to be placed on the rack.

Another aspect of the present invention relates to the manner in which comestible fluid dispensing components are mounted (whether on a comestible fluid container rack as described above or to another structure). In particular, some embodiments of the present invention provide a bracket to which a valve, pump, regulator, filter, or other fluid dispensing system component can be releasably mounted. The bracket can be moved and secured to different positions along a rail in order to provide mounting flexibility for installers, those who maintain or service the comestible fluid dispensing system (or components thereof), and other users. For example, the bracket can be slidable and securable to different positions along the rail. If desired, the rail can be attached to a comestible fluid container rack, such as to the vertical supports of a rack.

In some embodiments of the present invention, a comestible fluid container rack is provided having one or more supports on the rack positioned to support one or more comestible fluid containers. Each support can include a brace adapted to hold and/or support one or more comestible fluid conduits associated with the comestible fluid containers. In this manner, the braces can be employed to organize and secure the comestible fluid conduits in the rack, avoiding the conventional practice of haphazardly routing unsecured comestible fluid conduits in the rack.

Some embodiments of the present invention provide a comestible fluid container rack adapted to support a comestible fluid container, wherein the comestible fluid container rack comprises a first vertical support, a second vertical support, a first stretcher extending from the first vertical support, a second stretcher extending between the first and second vertical supports and coupled to the first stretcher, a first support coupled to and extending from the first stretcher, and a second support coupled to and extending from the second stretcher, wherein the second support is movable with respect to the first support such that at least a portion of the second support overlaps at least a portion of the first support in at least one relative position of the second support with respect to the first support.

In another aspect of the present invention, a comestible fluid container rack adapted to support a comestible fluid container is provided, and comprises a first vertical support, a second vertical support, a first stretcher extending from the first vertical support, a second stretcher extending between the first and second vertical supports and coupled to the first stretcher, a first support coupled to and extending from the first stretcher, and a second support coupled to and extending from the second stretcher, wherein the second support is movable with respect to the first support such that at least a portion of the second support nests within a portion of the first support in at least one relative position of the second support with respect to the first support.

In some embodiments, a comestible fluid container rack adapted to support a comestible fluid container is provided, and comprises first and second vertical supports, a first stretcher coupled to and extending laterally between the first and second vertical supports, a support coupled to the first stretcher at a location between the first and second vertical supports, and an extension coupled to and extending substantially laterally with respect to the support, wherein the extension has at least one surface upon which the comestible fluid container rests and defines a widened area of support upon which the comestible fluid container rests.

In yet another embodiment of the present invention, a support adapted to support a comestible fluid container on a comestible fluid container rack having front and rear lateral stretchers is provided, and comprises a first portion adapted to be supported on opposite ends by the front and rear stretchers, respectively, and a second portion located between the opposite ends of the first portion, wherein the second portion extends substantially laterally from the first portion to define a widened area of the support upon which the comestible fluid container rests.

Further features and a better understanding of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION

Figure 1:
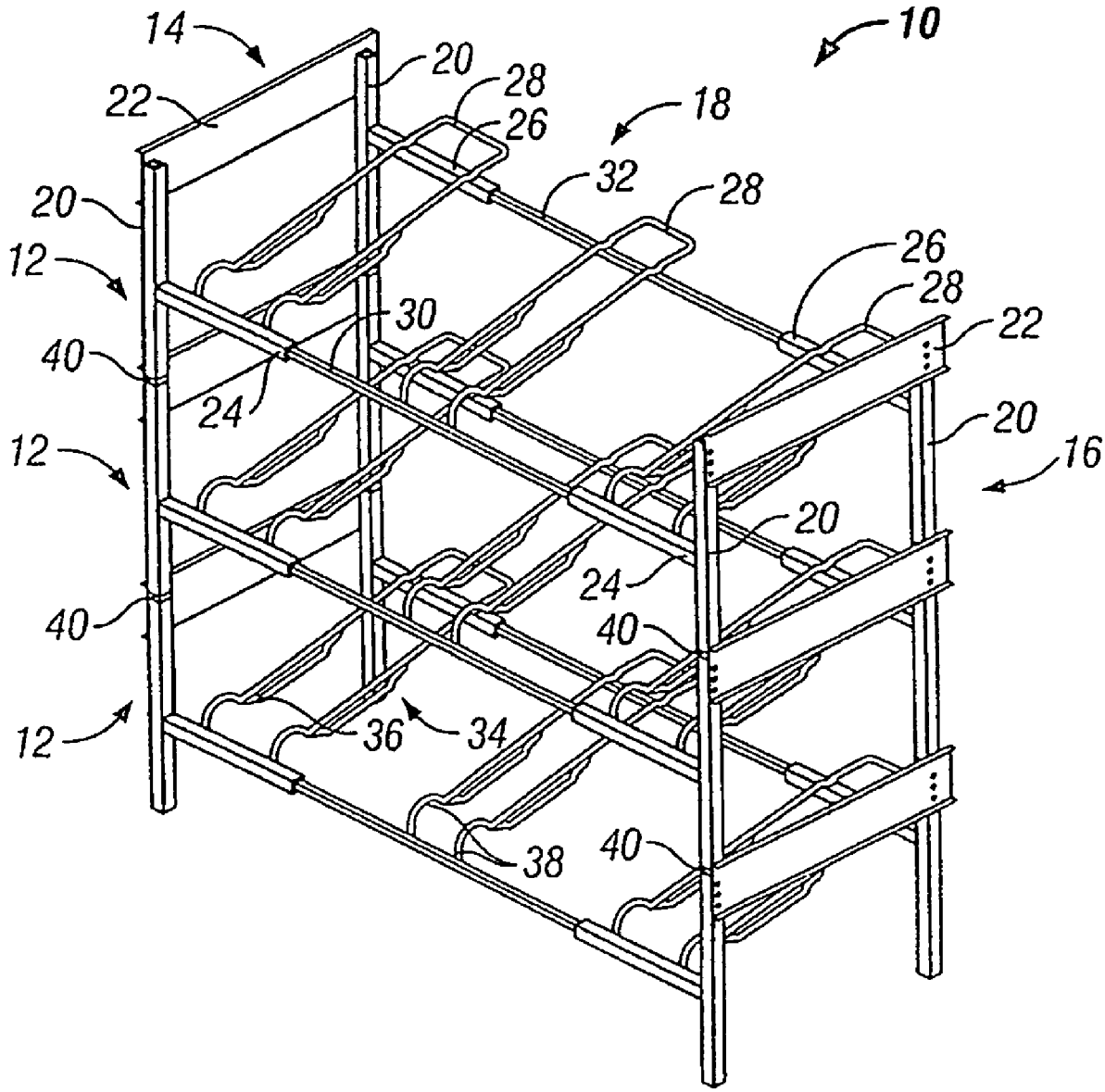
FIG. 1 is a perspective view of a rack according to an embodiment of the present invention.
Figure 2A:
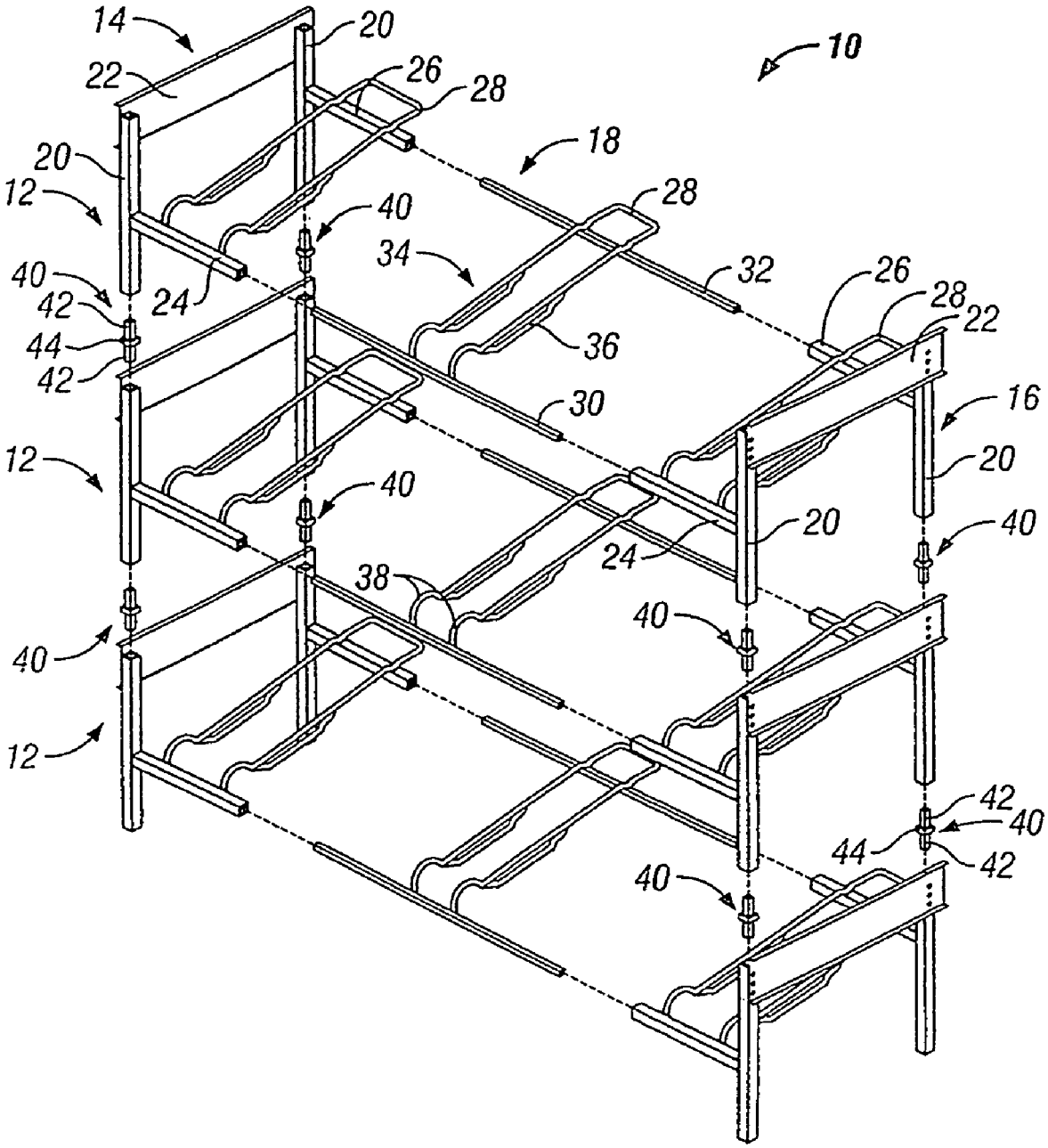
FIG. 2A is an exploded perspective view of the rack shown in FIG. 1.

An embodiment of a comestible fluid container rack according to the present invention is illustrated in FIGS. 1 and 2A. The illustrated rack (indicated generally at 10) is adapted for holding bag-in-box type comestible fluid containers. Bag-in-box comestible fluid containers typically have a port to which a conduit 64 can be releasably connected and through which comestible fluid can be pumped, drained, or otherwise removed from the container. Although the port in such containers is typically located near the bottom of the container, the port can be in any location on the container depending at least in part upon the manner in which comestible fluid is removed from the container. Bag-in-box comestible fluid containers are well-known to those in the art and are not therefore described further herein.

Although the illustrated embodiment of the rack 10 is adapted for holding bag-in-box type comestible fluid containers, it will be appreciated that the rack 10 can be adapted for holding any other type of comestible fluid container—such as in a manner enabling comestible fluid to be dispensed from the comestible fluid container while on the rack 10. Other types of comestible fluid containers include without limitation bottles, jugs, boxes, hoppers, bags, crates (e.g., lined or otherwise adapted to hold fluid), kegs, barrels, and the like.

The comestible fluid containers used in the rack of the present invention can hold any type of comestible fluid desired. By way of example only, such comestible fluids include syrups or other concentrated fluids for making carbonated beverages, non-carbonated beverages such as lemonade, tea, fruit juices, milk, and the like, condiments, and flowable food products.

For ease of description, the following text is with reference to a rack 10 adapted for holding bag-in-box syrup containers for making sodas, to syrup dispensing system components, and to equipment used to connect and mount such components. However, it should be noted that the present invention can be employed to hold any other type of comestible fluid container holding any other type of comestible fluid, can be employed in connection with the dispense of any other type of comestible fluid, and can be employed to connect and mount components of any other type of comestible fluid dispensing system.

The comestible fluid dispensing system illustrated in FIGS. 1 and 2A is comprised of multiple rack modules 12. Each rack module 12 includes three portions: first and second end portions 14, 16 and a center portion 18 connecting the first and second end portions. Each end portion 14, 16 includes two vertical supports 20, a rail 22 extending between and connecting the vertical supports 20, and two stretchers 24, 26 extending laterally from the vertical supports 20. A support 28 is connected to at least one (and in the case of the illustrated embodiment, both) of the stretchers 24, 26 of each end portion 14, 16, and spans the distance between the stretchers 24, 26.

The rails 22 can take any shape and size desired, and are illustrated as elongated plates in FIGS. 1 and 2A. By way of example only, the rails 22 can be rods, bars, tubes, angles, or sheets of material. The rails 22 can extend generally horizontally between the vertical supports 20 as shown in FIGS. 1 and 2A or can extend in any other manner, such as diagonally. If desired, each rack module 12 can have a single rail on each end of the rack module 12 as shown in FIGS. 1 and 2A, or can instead have two or more rails on each end. In still other embodiments, no rails 22 are employed (in which cases the vertical supports 20 of each end portion 14, 16 can be connected together in another manner, such as by elements coupled to and extending between front and rear stretchers 24, 26 or other stretcher elements of the rack 10). The rails 22 in the illustrated embodiment are welded to the vertical supports 20. However, the rails 22 can instead be connected to the vertical supports 20 in any other manner, such as by screws, bolts, pins, rivets and other conventional fasteners, by brazing or gluing the rails 22 to the vertical supports 20, by straps, inter-engaging or snap-fitting fingers, tabs, or other elements on the rails and/or vertical supports 20, and the like.

Although each rack module 12 illustrated in FIGS. 1 and 2A have four vertical supports 20 located at the corners of the rack module 12, it should be noted that each rack module 12 can have other numbers of vertical supports 20 arranged in any other manner desired. By way of example only, three or more vertical supports 20 (not shown) can be located on either side of the rack module 12. As another example, the vertical supports 20 can take the form of plates or panels (e.g., a plate or panel on each end of the rack module 12), frames, or other elements or structure providing support for the stretchers 24, 26 on both ends of the rack module 12.

In some embodiments such as that shown in FIGS. 1 and 2A, the stretchers 24, 26 of each end portion 14, 16 are vertically offset such that the supports 28 slope downward from the rear stretcher 26 to the front stretcher 24. Such a slope can promote drainage of syrup in bag-in-box containers having a tap at the lowest point on the front of the container. As used herein, the terms "front", "rear", "left", and "right" are employed to describe the orientation of elements in the illustrated embodiment of FIGS. 1, 2A, and 5. However, because the rack 10 of the present invention can be oriented in any manner desired, these terms are not intended to be limiting with regard to the manner in which the rack 10 of the present invention is positioned in any environment.

The supports 28 (if employed) can slope downward toward the front of the rack 10 in any amount desired. In some embodiments, the front and rear stretchers 24, 26 are vertically offset an amount sufficient to provide a 5-15 degree downward slope to the supports 28. In other embodiments, the front and rear stretchers 24, 26 are vertically offset an amount sufficient to provide a 7-12 degree downward slope to the supports 28. In still other embodiments, the front and rear stretchers 24, 26 are vertically offset an amount sufficient to provide a 9 degree downward slope to the supports 28. As an alternative or in addition to the use of vertically-offset stretchers 24, 26 as described above, a tilt can be provided to comestible fluid containers on the supports 28 by the shape of the supports 28 (as will be described in greater detail below).

With continued reference to the illustrated embodiment of FIGS. 1 and 2A, the center portion 18 of each rack module 12 includes a front stretcher 30, a rear stretcher 32, and a support 28 spanning the distance between and coupled to the front and rear stretchers 30, 32. In other embodiments, two or more supports 28 can extend between and be coupled to the front and rear stretchers 30, 32. Such additional supports 28 can be employed to increase the storage capacity of the rack module 12.

With particular reference to FIG. 2A, each rack module 12 can be assembled by arranging the front and rear stretchers 24, 26 of the end portions 14, 16 with the front and rear stretchers 30, 32 of the center portion 18. In the illustrated embodiment, the front and rear stretchers 24, 26 of the end portions 14, 16 are made of tubular material enabling the front and rear stretchers 30, 32 of the center portion 18 to be received therein in a telescoping relationship. In this manner, the end portions 14, 16 of each rack module 12 are slidable with respect to the center portion 18, enabling a user to change the length of the rack module 12 (between the end portions 14, 16). Such adjustability enables a user to adjust the rack modules 12 (and therefore, the rack 10) to accept different numbers, different sizes, and/or different arrangements of syrup containers. Provided that the end portions 14, 16 of the rack module 12 are separated a sufficient distance from one another, such adjustability can also enable the center portion 18 (and any supports 28 thereon) to be moved to different positions with respect to the end portions 14, 16. This adjustability of the center portion 18 enables a user to adjust the rack modules 12 to support different numbers, different sizes, and different arrangements of syrup containers.

It will be appreciated by one skilled in the art that the stretchers 24, 26 of the first and second end portions 14, 16 can telescope with respect to the stretchers 30, 32 of the center portion 18 in a number of different manners. Specifically, the manner in which one element "telescopes" with respect to another does not indicate or imply any particular cross-sectional shape of the elements, nor that one element must be completely surround another. As used herein and in the appended claims, the term "telescope" in its various forms means that one element (e.g., a stretcher 24, 26, 30, 32) is axially positionable with respect to another and that the elements are coupled together (a) by virtue of one being partially or entirely received within the other and/or (b) by virtue of another connection between the elements (e.g., one or more fasteners or other structure connecting one of the elements to the other).

In some embodiments, the stretchers 30, 32 of the center portion 18 and the stretchers 24, 26 of the end portions have a clearance fit or have a sufficiently loose fit to enable the stretchers 30, 32 and 24, 26 to freely move with respect to one another. Although in some embodiments the stretchers 24, 26, 30, 32 can be freely removed from one another, in other embodiments the stretchers 24, 26, 30, 32 can be provided with stops that prevent the center portion stretchers 30, 32 from being removed from the end portion stretchers 24, 26 or from being extended from the end portion stretchers 24, 26 over a desired amount. The stops can take any form desired, such as an internal rib, flange, or pin on each end portion stretcher 24, 26 that engages an external flange, pin, or other protrusion on a mating center portion stretcher 30, 32 when the center portion stretcher 30, 32 has been extended from the end portion stretcher 24, 26 a sufficient amount. As another example, the stops can be defined by a retractable protrusion extending from each center portion stretcher 30, 32 into engagement with a groove, recess, or other aperture in a mating end portion stretcher 24, 26 (or vice versa) when the center portion stretcher 30, 32 has been pulled from the mating end portion stretcher 24, 26 a sufficient amount.

With regard to two or more elements in telescoping relationship with one another, one having skill in the art will appreciate that a number of different manners, elements, and structure exist for preventing the complete removal of one telescoping element from another or for limiting the amount that one telescoping element can extend from another. Any such manner, elements, and structure can be employed to limit the extension of the center portion stretchers 30, 32 from the end portion stretchers 24, 26 and fall within the spirit and scope of the present invention.

In some embodiments such as that shown in FIGS. 1 and 2A, the center portion stretchers 30, 32 are received within the end portion stretchers 24, 26 with a snug fit or a fit that otherwise provides some resistance against free movement of the center portion stretchers 30, 32 with respect to the end portion stretchers 24, 26. In this manner, the stretchers 24, 26, 30, 32 can be moved under force to desired positions with respect to one another and can remain in such positions until forced therefrom. This adjustability permits an assembler or other user to adjust the rack modules 12 to two or more desired lengths (and in some cases a range of desired lengths) as needed or desired to accommodate different numbers and/or sizes of comestible fluid containers.

Other manners of retaining a rack module 12 at a desired length by releasably retaining the center portion stretchers 30, 32 in respective positions relative to the end portion stretchers 24, 26. By way of example only, resiliently biased detents located on the center portion stretchers 30, 32 and/or on the end portion stretchers 24, 26 can extend into grooves, recesses, or other apertures in the end portion stretchers 24, 26 and/or center portion stretchers 30, 32, respectively. Any conventional detent element or device used to releasably secure telescoping poles or tubes in a desired position can be employed as desired. In some embodiments, the center portion stretchers 30, 32 can be releasably secured in two or more different positions with respect to the stretchers 24, 26 of either or both end portions 14, 16. For example, the center portion stretchers 30, 32 can be telescoped with respect to the end portion stretchers 24, 26 to selectively engage resiliently biased detents with one of two or more grooves, recesses, or other apertures. Any conventional detent element or device used to releasably secure telescoping poles or tubes in one of two or more desired positions can be employed as desired.

As another example, the center portion stretchers 30, 32 and end portion stretchers 24, 26 can each be provided with one or more apertures through which a pin, screw, key, or other element can be passed to secure the center portion stretchers 30, 32 in position with respect to the end portion stretchers 24, 26. Specifically, the center portion stretchers 30, 32 can be telescoped with respect to the end portion stretchers 24, 26 to one or more positions in which one or more apertures in both types of stretchers 24, 26, 30, 32 are aligned. At such positions, a pin, screw, key, or other element can be passed through the aligned apertures to retain the stretchers 24, 26, 30, 32 in their relative positions. In this manner, the portions 14, 16, 18 of the rack module 12 can be secured together in a particular manner (e.g., at a particular length). In those cases in which stretcher apertures are aligned in two or more different relative positions of the stretchers 24, 26, 30, 32, such apertures also enable the rack modules 12 to be adjustable to different lengths.

Still other manners exist for securing a first element in one or more different positions with respect to a second element in telescoping relationship with the first element. For example, the exterior element can have a longitudinal groove through which a fastener (e.g., a bolt or screw) passes that can be tightened to secure the telescoping elements in different positions with respect to one another, the interior element can be threaded into the exterior element, the elements can be shaped so that one moves freely within the other in at least one rotational orientation of the elements but is resistant to axial movement when rotated to a different rotational orientation (e.g., telescoping oval tubes), and the like. All such manners for securing one telescoping element in different axial positions with respect to another can be employed in the stretchers 24, 26, 30, 32 described above, and falls within the spirit and scope of the present invention.

The rack modules 12 in the illustrated embodiment of FIGS. 1 and 2A each have center portion stretchers 30, 32, flanked by and telescoping within end portion stretchers 24, 26 as described in greater detail above. However, it will be appreciated that the length of the rack modules 12 can be adjusted in other manners using different elements and structure. By way of example only, the center portion stretchers 30, 32 can be dimensioned to receive the end portion stretchers 24, 26 rather than to be received within the end portion stretchers 24, 26 as described above. Alternatively, one end of the center portion stretchers 30, 32 can be dimensioned to be received within the stretchers 24, 26 of one end portion 14 while the other end of the center portion stretchers 30, 32 can be dimensioned to receive the stretchers 24, 26 of the other end portion 16. As another example, the center portion stretchers 30, 32 can be connected to telescope only with respect to the stretchers 24, 26 of one of the end portions 14, 16 (while being rigidly connected to the stretchers 24, 26 of the other end portion 16, 14). Other embodiments of the present invention have no center portion 18, and instead employ stretchers 24, 26 of one end portion 14, 16 that telescope within stretchers 26, 24 of another end portion 16, 14 in any manner (such as those described above). In still other embodiments, the end portions 14, 16 of the rack modules 12 can be connected by stretcher assemblies each having four or more telescoping stretchers (rather than the stretcher assemblies described above in which each stretcher assembly is defined by two end portion stretchers 24, 26 and one center portion stretcher 30, 32. Any of these types of telescoping connections between the end portions 14, 16 of the rack modules 12 can employ any of the elements and features described above in order to secure the end portions 14, 16 in desired relative positions (in an adjustable or non-adjustable manner).

In some embodiments, it may be desirable to provide additional structural stability to the rack modules 12 by connecting the front stretcher 24, 30 to the rear stretchers 26, 32 with beams, tubes, rods, bars, or other elements. Such elements can be connected to the stretchers 24, 26, 30, 32 in any manner, such as by welding, brazing, or gluing, by fasteners (e.g., clips, screws, clamps, rivets, and the like connecting the elements to the stretchers 24, 26, 30, 32), or by engagement with the stretchers 24, 26, 30, 32 (e.g., the ends of the elements being inserted into apertures in the stretchers 24, 26, 30, 32, being snap-fitted to the stretchers 24, 26, 30, 32, and the like).

With continued reference to FIGS. 1 and 2A each rack module 12 has two sets of stretchers 24, 26, 30, 32 (i.e., front and rear). However, it will be appreciated that each module 12 can have any number of stretcher sets located in different areas of the module 12. For example, three or four sets of stretchers 24, 26, 30, 32 can laterally extend between the vertical supports 20 of each end portion 14, 16. The sets of stretchers 26, 26, 30, 32 in each module 12 can be located in any position or positions between the top and bottom of each module 12 and between the front and rear of each module 12 as desired.

The vertical supports 20 and the stretchers 24, 26, 30, 32 of the modules 12 illustrated in FIGS. 1 and 2A are made of hollow tubing having a square cross sectional shape. However, the vertical supports 20 can have any solid or hollow cross-sectional shape. Similarly, the stretchers 24, 26, 30, 32 can have any cross-sectional shape desired, limited only by the ability of the stretchers 24, 26, 30, 32 to telescope as described above. In this regard, the center portion stretchers 30, 32 in FIGS. 1 and 2A need not necessarily be hollow to perform their telescoping functions. In those embodiments of the present invention in which the stretchers 24, 26, 30, 32 do not need to telescope (described in greater detail below), the stretchers 24, 26, 30, 32 can take any form desired.

As just indicated, the stretchers 24, 26, 30, 32 of the rack modules 12 need not necessarily be in telescoping relationship with one another as described above. In particular, in some embodiments the end portion stretchers 24, 26 are adjustably coupled together or to center portion stretchers 30, 32 without a telescoping relationship. For example, the stretchers 24, 26, 30, 32 can be beams, bars, or other elements each having one or more apertures therethrough. When the stretchers 24, 26 of one end portion 14 are brought to positions adjacent to the stretchers 30, 32 of the center portion 18, the apertures in the end portion stretchers 24, 26 can be aligned with the apertures in the center portion stretchers 30, 32, after which time pins, fasteners, keys, or other elements can be passed through the aligned apertures to connect the stretchers 24, 26 of the end portion 14 to those of the center portion 18. Connection of the center portion stretchers 30, 32 to the stretchers 24, 26 of the other end portion 16 can be made in a similar fashion. In cases where multiple apertures are employed in some or all of the stretchers 24, 26, 30, 32, such an arrangement permits adjustability of the length of the rack module 12. Other manners of adjustably or non-adjustably connecting the end portion stretchers 24, 26 to the center portion stretchers 30, 32 without a telescoping relationship are possible and fall within the spirit and scope of the present invention.

As mentioned above, each rack module 12 illustrated in FIGS. 1 and 2A has supports 28 extending between the front and rear stretchers 24, 30; 26, 32. Although some embodiments of the present invention employ rack modules 12 having no supports 28, such supports 28 can provide additional strength to the rack modules 12 and can help to support comestible fluid containers in the rack modules 12. Each rack module 12 can have any number of supports 28 located in any position along the length of the rack module 12. In the illustrated embodiment of FIGS. 1 and 2A, a support extends between the stretchers 24, 26 of each end portion 14, 16 and between the stretchers 30, 32 of the center portion 18. Other embodiments of the present invention can employ any combination of these supports 28, such as supports 28 only on the end portion stretchers 24, 26, one or more supports only on the center portion stretchers 30, 32, and the like.

Each support 28 in the illustrated embodiment includes a wire frame shaped to support the underside of a bag-in-box type comestible fluid container. Alternatively, the supports 28 can take other forms capable of performing the same function, such as one or more rods, plates, bars, beams, tubes, or other elements extending between the front and rear stretchers 24, 30 and 26, 32.

Figure 5:
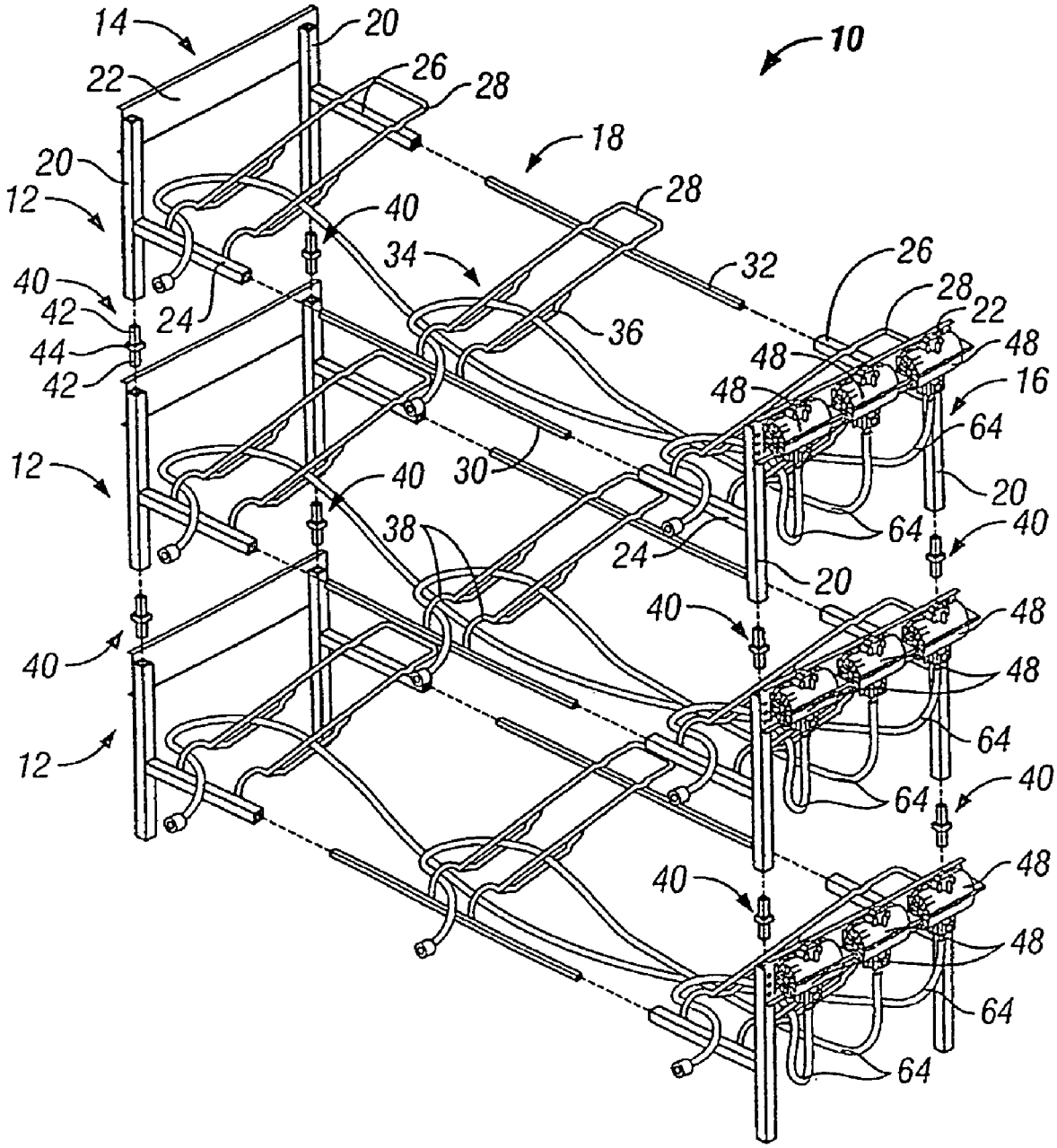
FIG. 5 is an exploded perspective view of the rack shown in FIG. 1, shown with three of the rail and bracket assemblies shown in FIG. 4 and with comestible fluid dispensing components installed on the rack.

In some embodiments, some or all of the supports 28 are provided with one or more conduit braces 34 for holding and/or supporting conduits 64 running in the rack 10. The conduit braces 34 can take a number of different forms each capable of performing either or both of these functions. In the embodiment illustrated in FIGS. 1 and 2A for example, each support 28 has two elongated loops 36 through which comestible fluid conduits 64 can be passed as shown in FIG. 5. The conduit braces 34 (where employed) can be used to neatly secure conduit 64 therethrough, thereby eliminating additional hardware required to organize and secure the conduit 64.

The elongated loops 36 in the embodiment of FIGS. 1 and 2A are defined by part of the wire frame of the supports 28, although this is not necessarily the case. In other embodiments, elements can be connected to the supports 28 in any manner to at least partially define the loops 36 or other conduit brace structure. For example, wire, rods, bars, and other elements can be coupled to the supports 28 by welding, brazing, gluing, by one or more conventional fasteners (e.g., clamps, straps, ties, threaded fasteners, and the like). Accordingly, the supports 28 can have elements or structure for holding and/or retaining comestible fluid lines in the rack 10, such elements being integral with respect to the supports 28 or separate elements coupled to the supports 28. Although the conduit braces 34 can take the form of loops as described above, other shapes of the conduit braces 34 are possible, including without limitation hooks, rings, lugs, fingers and other extensions, and the like.

With continued reference to the conduit braces 34 illustrated in FIG. 1, some conduit braces 34 according to the present invention are shaped to have one or more tapered ends. For example, the conduit braces 34 in the illustrated embodiment are loops having front and rear ends that are tapered (i.e., the portions or surfaces of the conduit brace 34 through or in which the comestible fluid conduits are held are disposed at an acute angle with respect to one another). This conduit brace shape enables a user to move a comestible fluid conduit within the conduit brace 34 to a location at the taper in which the conduit brace 34 grips the comestible fluid conduit. In some embodiments, the amount of grip provided by the tapered portion(s) of the conduit brace 34 is sufficient to retain the comestible fluid conduit within the conduit brace 34 but is not sufficient to appreciably deform the comestible fluid line or to constrict flow therethrough. Although the tapered portions of the conduit braces 34 illustrated in FIGS. 1, 2A, and 5 are shown in a wire-type support 28, it should be noted that tapered portions or surfaces can be employed in any other type of support 28 (including the alternative supports 28 described herein) to perform any of the same functions discussed above. In addition, the tapered portion(s) of the conduit brace 34 need not necessarily be located at an end of the conduit brace 34. The tapered portions can each be defined by one or more bumps, bosses, ramps, ribs, or other protrusions of the conduit brace 34 and/or support 28 and upon which a comestible fluid conduit can be moved to wedge or grip the comestible fluid conduit in position with respect to the support 28.

In some embodiments, the conduit braces 34 can be movably attached to the supports 28 and/or to the stretchers 24, 26, 30, 32 in order to enable easier installation and routing of conduits 64 therethrough. By way of example only, the conduit braces 34 can be pivotably attached to the supports 28 or can be releasably attached to the supports 28 in any manner so that the conduit braces 34 can be opened and closed during conduit 64 installation. Any latching or mating engagement of the conduit braces 34 to the supports 28 can be employed to secure the conduit braces 34 in closed positions on the supports 28.

The supports 28 in the embodiment of the present invention illustrated in FIGS. 1 and 2A are shaped to prevent or help prevent the comestible fluid containers from falling off of the rack 10. Although the stretchers 24, 26, 30, 32 can be positioned (and in some cases, shaped) to perform this function without the assistance from the supports 28, the supports 28 can provide a more stable foundation for the comestible fluid containers. Each support can be substantially flat or can take any other shape adapted to perform the function of supporting the comestible fluid containers. In those cases where the comestible fluid containers are to be supported in a tilted orientation, the supports 28 can have a stop, ledge, rib, protrusion, or can otherwise be shaped to prevent the comestible fluid containers from sliding off the lower end of the supports 28. For example, each support 28 illustrated in FIGS. 1 and 2A has stops 38 at the front lower end thereof to prevent the bag-in-box containers from sliding forwardly off of the rack 10. In some embodiments, the supports 28 can be shaped to tilt the comestible fluid containers if desired, such as ramp or wedge-shaped supports 28, supports having one or more elevated points (such as at the rear of each support), and the like. Supports 28 having such shapes can be employed as an alternative to or in addition to offset front and rear stretchers 24, 26, 30, 32 as described above.

Supports 28 can be located in any position or positions between the vertical supports 20, and need not necessarily be located on the front and rear stretchers 24, 26 of either or both end portions 14, 16 or on the front and rear stretchers 30, 32 of the center portion 18. Any arrangement of supports 28 on any of the front and rear stretchers 24, 30; 26, 32 is possible.

The supports 28 in the illustrated embodiment of FIGS. 1 and 2A are attached to the stretchers 24, 26, 30, 32 by welds. However, the supports 28 can be attached to the stretchers 24, 26, 30, 32 in any other releasable or non-releasable manner, including without limitation by brazing, clamps, gluing, screws and other threaded fasteners, rivets, pins, snap-fitting, and the like. In this regard, it may be desirable to move the supports 28 to different positions with respect to the stretchers 24, 26, 30, 32 as the need may arise, such as to support comestible fluid containers in different locations along the length of the rack, to provide different comestible fluid container spacing, and the like. Such flexibility is available to some degree by the attachment of supports 28 to telescoping stretchers 24, 26, 30, 32 as described above or to stretchers 24, 26, 30, 32 that are otherwise movable to different positions with respect to one another.

However, increased flexibility is enabled by permitting releasable attachment of the supports 28 to different locations on the stretchers 24, 26, 30, 32. In some cases, the supports 28 are releasably attached to the front and rear stretchers 24, 26, 30, 32, while in other cases the supports 28 are releasably attached only to the front stretchers 24, 30 or only to the rear stretchers 26, 32 while being unattached to the other stretchers. One or more of the supports 28 can be releasably attached to the stretchers 24, 26, 30, 32 in a number of different manners, such as by receiving the ends of the supports within apertures in the stretchers 24, 26, 30, 32, by receiving legs, pins, fingers, tabs, or other extensions of the supports 28 in apertures in the stretchers 24, 26, 30, 32, by strapping or tying the supports 28 to the stretchers 24, 26, 30, 32, by magnet sets attached in any conventional manner to the supports 28 and to the stretchers 24, 26, 30, 32, by clamps or clips on the supports 28 and/or stretchers 24, 26, 30, 32, by screws, pins, or other releasable fasteners tightenable to secure the supports 28 to the stretchers 24, 26, 30, 32, and the like. Still other manners of releasably connecting the supports to one or more positions on the stretchers 24, 26, 30, 32 are possible, each of which falls within the spirit and scope of the present invention. In some embodiments, such manners of connection enable the user to position and secure the supports 28 in two or more locations (and in some cases, a range of locations) along the stretchers 24, 26, 30, 32.

Whether the position of supports 28 on the rack module 12 are adjustable by virtue of the telescoping relationship of the stretchers 24, 26, 30, 32 or by the ability to releasably attach the supports 28 in different positions on the stretchers 24, 26, 30, 32 as described above, in some embodiments the supports 28 are movable in the rack module 12 to different lateral positions to provide support as needed by comestible fluid containers in the rack module 12. By way of example only, the center support 28 in FIGS. 1, 2A, and 5 can be laterally adjustable to the left and/or right in order to support comestible fluid containers having different sizes and weights in the rack module 12. In some cases, (such as when some part or all of the support 28 has a relatively wide shape), one or more supports 28 can be shaped to move under or over one or more adjacent supports 28 on the rack module 12 as needed or desired. For example, if the supports 28 illustrated in FIGS. 1, 2A, and 5 were shaped to have laterally-extending wings or other portions providing a wider base upon which comestible fluid container(s) can rest, such wings or other portions could be shaped to slide under or over adjacent supports 28 on the rack module 12 (see FIGS. 6-8).

Figure 2B:
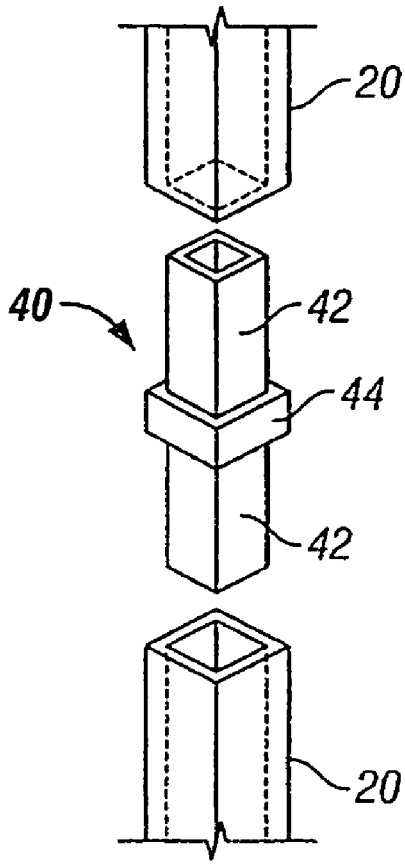
FIG. 2B is a perspective view of a coupling employed in the rack illustrated in FIGS. 1 and 2A.

Some embodiments of the present invention provide the ability to expand the rack 10 by stacking rack modules 12 on top of one another. Although the rack modules 12 can be stacked without connecting the rack modules 12 together, in some embodiments the rack modules 12 are connected for increased rack stability and strength. Stacked rack modules 12 can be attached to one another in a number of different manners, one of which is illustrated in FIGS. 1 and 2A. Specifically, couplings 40 are employed to connect the vertical supports 20 of one rack module 12 to the vertical supports 12 of another. The couplings can be made of any sufficiently resilient and strong material (such as plastic, rubber, nylon, elastomeric material, metal, composites, wood, and the like). With particular reference to FIG. 2B, the couplings 40 are shaped to be received within the hollow tubular ends of the vertical supports 12, thereby connecting the vertical supports 12 to one another. Each coupling 40 has stems 42 with outer dimensions sized to provide at least a snug fit with the vertical supports 20 and a center bushing 44 between the stems. In some cases, the coupling 40 is made at least partially of resilient material such as rubber, urethane, nylon, or other elastomeric material in order to provide an interference fit between the stems 42 and the hollow vertical supports 20 of the rack modules 12, thereby interlocking vertically adjacent rack modules 12. The resilient couplings 40 allow the rack modules 12 to be stacked upon one another to vertically expand the rack. The couplings 40 can be releasably attached to both the bottom and top of each rack module 12 or can be permanently attached to either the bottom or top ends of the vertical supports 20.

In some embodiments, the couplings 40 are defined by ends of the vertical supports 20 shaped to mate with the ends of vertical supports 20 on another rack module 12 (e.g., reduced ends on the top or bottom of the vertical supports 20 mating with hollow ends of vertical supports 20 on another rack module 12, flared ends on the top or bottom of the vertical supports 20 mating with ends of the vertical supports 20 on another rack module 12, and the like). In other embodiments, the couplings 40 are elements that are received around one or both ends of adjacent vertical supports 20 in order to connect vertically adjacent rack modules 12. For example, sleeves or sockets can be connected to the ends of adjacent vertical supports 20 in order to connect the supports 20 together.

In still other embodiments, the couplings 40 can be flanges, collars, tabs, or other extensions on the upper and lower ends of the vertical supports 20. The flanges, collars, tabs, or other extensions of one module can be permanently or releasably connected to those of another in order to connect the vertical supports 20 together, such as by bolts, screws, pins, or other conventional fasteners passed through aligned apertures in the flanges, collars, tabs, or other extensions. Alternatively, adjacent vertical supports 20 can be connected together by clasps or latches on the ends of the vertical supports 20, conventional fasteners passed through or around the adjacent ends of the vertical supports 20, snap-fitting the vertical support ends of one rack module 12 into those of another, detents (spring-loaded or otherwise) on the vertical support ends of one rack module 12 engaging those of another, braces spanning the joint between adjacent vertical supports 20, and the like.

As shown in FIG. 5, the couplings 40 can enable the quick assembly and disassembly of a rack 10 comprised of multiple rack modules 12. In some embodiments, the couplings 40 allow the rack 10 to be disassembled into individual rack modules 12 for easy transport, with each rack module 12 capable of supporting one or more comestible fluid containers and fluid dispensing components (including conduits 64) during transport. Likewise, after transport, the couplings 40 can permit the user to quickly reassemble the rack 10. Depending at least partially upon the strength of the vertical supports 20, any number of rack modules 12 can be stacked upon one another to provide significant expandability of the rack 10 according to the present invention. However, in some embodiments of the present invention, the rack 10 is defined by a single rack module 12.

If desired, the top rack module 12 of a rack 10 can be used to support other structure, such as an additional shelf, other equipment, and the like. By way of example only, a telescoping shelf (i.e., having one or more leaves telescoping with respect to one another) can be stacked upon the vertical supports 20 of the uppermost rack module 12, and can be connected thereto in any conventional manner. Any type of telescoping or expandable shelf can be employed, such as a shelf having one or more panels laterally slidable into one or more tubular panels, one or more panels having a C-shaped cross-section laterally slidable over one or more other panels, and the like. Any such telescoping or expandable shelf can be used and can be adjustable to a length corresponding to the length of the rack 10.

Figure 4:
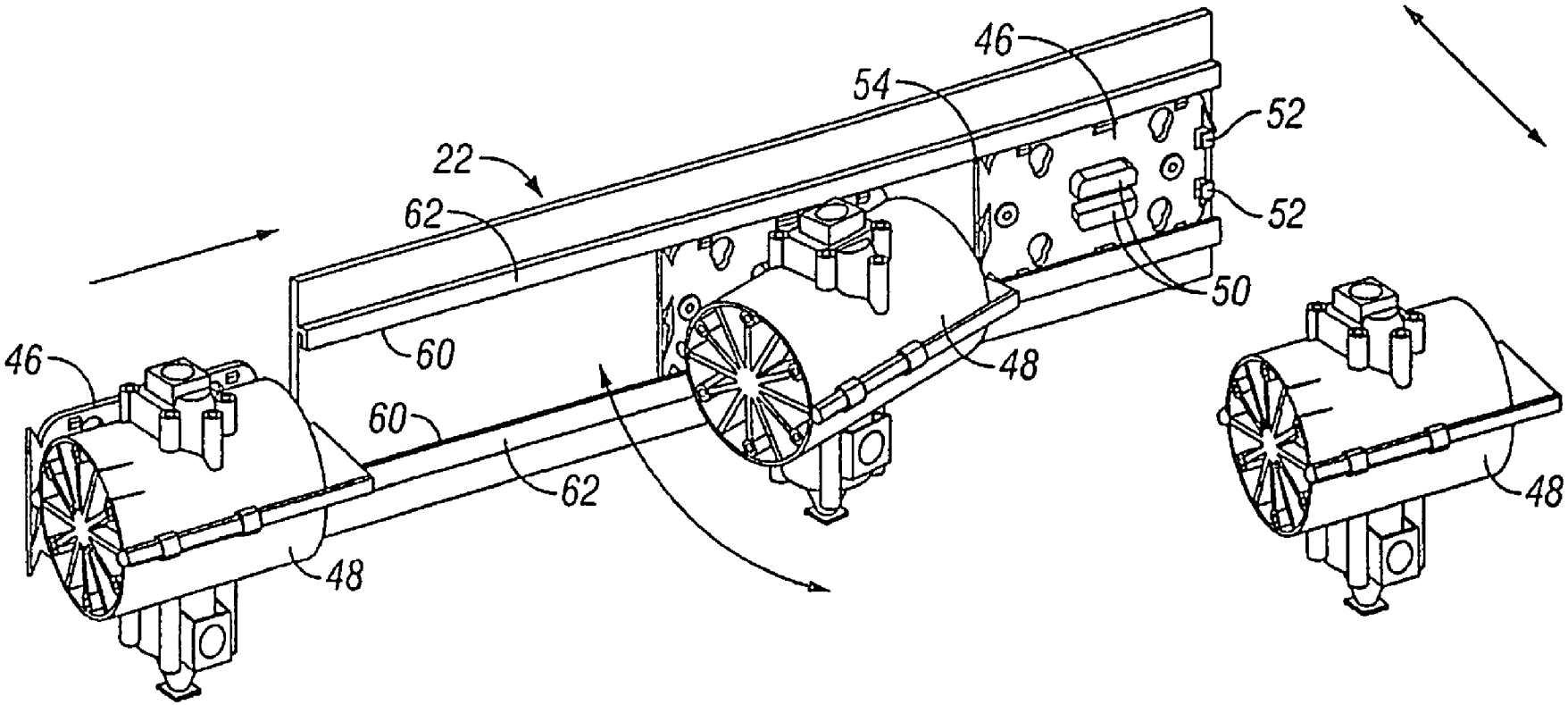
FIG. 4 is a perspective view of a rail and bracket assembly according to an embodiment of the present invention.

With reference now to FIG. 4, one or more rails 22 of the rack 10 can be employed not only to provide structural strength and stability to the rack 10, but also as a mounting location to which comestible fluid dispensing components can be permanently or releasably mounted to the rack 10. Such comestible fluid dispensing components include without limitation, pumps, ASVs and other valves, filters, regulators, and fluid treatment devices. Any number and combination of such comestible fluid dispensing components can be permanently or releasably mounted to the rail 22.

The rails 22 can be located in any vertical position on one or more rack modules 12 of the rack 10. However, it is often desirable to connect one or more rails 22 of a rack module 12 to the vertical supports 28 at a higher elevation than the outlets of the comestible fluid containers on the rack module 12. In some cases, some comestible fluid dispensing components operate at less than optimal performance or perform poorly when positioned at an elevation that is the same or lower than the dispensing outlet of a connected comestible fluid container. For example, positioning a pump at a lower elevation than the outlet of a bag-in-box comestible fluid container connected thereto can cause air to be entrained in a conduit extending between the pump and the comestible fluid container. Some embodiments of the present invention can address this and other dispensing system performance problems by positioning the rail 22 at a higher elevation than the dispensing outlets of comestible fluid containers connected to pumps and other components on the rail 22. By employing a rail 22 positioned in this manner, the need for an assembler or user to quickly find a suitable mounting location for one or several condiment dispensing system components at suitable elevations (often a difficult task using conventional equipment) is met.

Figure 3:
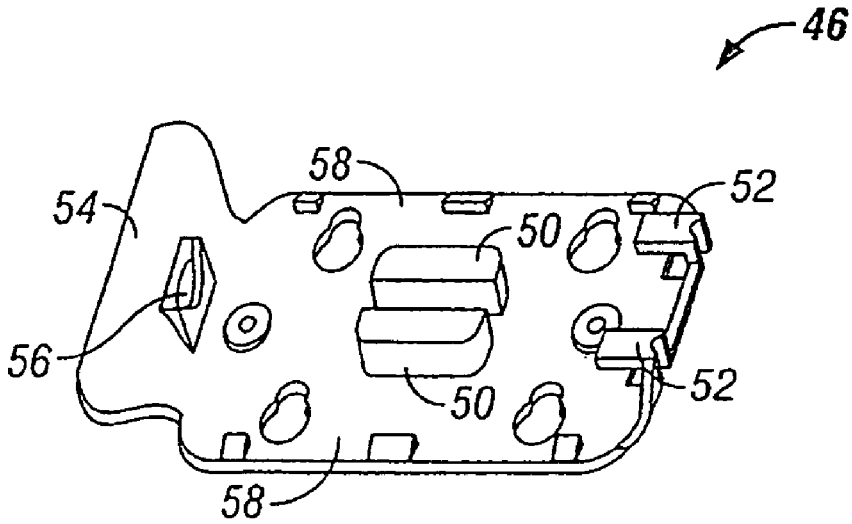
FIG. 3 is a perspective view of a bracket according to an embodiment of the present invention.

Comestible fluid dispensing components can be mounted anywhere upon the rail 22 in a number of different manners, such as by securing the components to the rail using one or more screws, bolts, rivets, pins, and other conventional fasteners, by welds, brazing, or gluing the components to the rail 22, by straps, inter-engaging or snap-fitting fingers, tabs, or other elements on the rail 22 and/or comestible fluid dispensing components, and the like. However, in some embodiments, comestible fluid dispensing components are mounted to the rail 22 by a bracket 46 as best shown in FIGS. 3 and 4. The bracket 46 can have any shape desired, and in some cases is defined by a generally planar body having one or more extensions used for connecting a comestible fluid dispensing component 48 thereto and/or for manipulating the bracket 46. By way of example only, the comestible fluid dispensing components 48 illustrated in FIGS. 4 and 5 are pumps (e.g., "Heavy Duty Advantage" Bag-In-Box gas pump manufactured by SHURflo, Inc.).

With particular reference to FIG. 3, the exemplary illustrated bracket 46 has a pair of raised bosses 50, a pair of fingers 52, a lever 54, and an aperture 56 in the lever 54 for connecting the pump 48 shown in FIGS. 4 and 5 to the bracket 46. In particular, the raised bosses 50 receive a rail or other protrusion of the pump 48, the fingers 52 are received within apertures in the pump, and the aperture 56 in the lever 54 receives a pin or other protrusion on an end of the pump 48. As best shown in FIG. 4, this arrangement of elements enables a user to connect the pump 48 to the bracket 46 by snapping the pump 48 into the bracket 46 (which can include pivoting the pump 48 into place on the bracket 46 as shown in FIG. 4). To release the pump 48, the lever 54 is pressed so that the pin or other protrusion on the end of the pump 48 is released from the aperture 56 in the lever 54, thereby permitting the pump 48 to be removed from the bracket 46.

Although the bracket 46 illustrated in FIGS. 3 and 4 has the bosses 50, fingers 52, lever 54, and lever aperture 56 as just described, it will be appreciated that the pump 48, other types of pumps, and other comestible fluid dispensing components can be releasably or permanently mounted to the bracket 46 in a number of other manners employing a number of other features on the bracket 46. By way of example only, the bracket 46 can have one or more pins that mate with apertures in the comestible fluid dispensing component (and vice versa), can have one or more fingers, tabs, flanges, or other extensions to which the comestible fluid dispensing component can mate or otherwise be engaged, can have one or more straps or other elongated elements that extend around any part of the comestible fluid dispensing components, can have one or more recesses shaped to receive part of the comestible fluid dispensing components, can have one or more clips extending therefrom for engagement with features on the comestible fluid dispensing components 48, can engage the comestible fluid dispensing component by a sliding or rotating engagement (e.g., via inter-engaging teeth, flanges, pins, or other elements on the bracket 46 and comestible fluid dispensing component), and the like.

For example, a comestible fluid dispensing component 48 can be mounted on the bracket 46 via apertures (e.g., holes, recesses, grooves, slots, and the like) in the bracket 46. In the case of comestible fluid dispensing components that do not employ a pin and lever mounting configuration as illustrated in the figures, these apertures can engage posts, pins, or other extensions (not shown) on the comestible fluid dispensing component 48 in order to secure the component 48 to the bracket 46.

In some embodiments, the bracket 46 has connection elements or features for mounting two or more different types of comestible fluid dispensing components on the same bracket 46, such as a pump and an ASV, pumps having different shapes, sizes, dimensions, and the like.

With continued reference to FIG. 4, the brackets 46 in the illustrated embodiment are slidable to different positions along the rail 22 by a sliding connection between the brackets 46 and the rail 22. Specifically, one or more edges 58 of the bracket 46 are dimensioned to be slidably received within one or more grooves 60 running along the rail 22. The grooves 60 can be defined in the rail 60 in any manner, and in some cases (such as that shown in the figures) are defined by elongated walls 62 in the rail 60. The bracket 46 can be received within the groove(s) 60 with a clearance fit or can be received with a snug fit permitting movement of the bracket 46 along the rail 22 with sufficient force applied to the bracket 46.

The brackets 46 in the illustrated embodiment of FIGS. 3-5 can be movable to any number of different positions along the rail 22. In some embodiments, the bracket 46 is movable to two or more discrete positions on the rail 22, while in other embodiments the bracket 46 is movable to any position within a range of positions along the rail 22. The positions can be along the entire length or substantially the entire length of the rail 22 or can be in only a portion of the rail 22 as desired.

As an alternative to brackets 46 slidable within one or more grooves 60 in the rail 22, the brackets 46 can be permanently or releasably mounted in different positions along the rail 22 in other manners. For example, in some embodiments the rails 22 have two or more fasteners spaced apart along the rail 22 and that extend into engagement with the bracket 46 in different positions along the rail 22. As another example, the bracket 46 can be provided with one or more releasable fasteners that can be tightened to secure the bracket 46 in different locations along the rail 22. In other embodiments, the bracket 46 can have flanges in or between which is received the rail 22 (or part of the rail 22) so that the bracket 46 can be slid or otherwise moved to different locations along the rail 22. In still other embodiments, the bracket 46 can have or be defined by an element partially or entirely encircling the rail 22 and that can be slidable to different positions along the rail 22. As another example, the rail 22 can have a raised rib that mates with a recess in the bracket 46 and along which the bracket 46 can be slid or otherwise moved to different positions along the rail 22. Alternatively, the bracket 46 can have one or more ribs, fingers, pins, posts, flanges, bosses or other extensions that are received within a groove or other elongated aperture in the rail 22 permitting the bracket to be slid or otherwise moved to different positions along the rail 22. In other embodiments, the rail 22 can have two or more apertures along its length that can be aligned with one or more apertures in the bracket 46 (or vice versa) so that a pin, post, threaded fastener, key, or other element can be received within aligned apertures to secure the bracket 46 in different positions along the rail 22. One having ordinary skill in the art will appreciate that still other manners of mounting the bracket 46 in an adjustable manner along the rail 22 are possible and fall within the spirit and scope of the present invention.

The ability to adjust the position of the brackets 46 (and therefore, the comestible fluid dispensing components) on the rail 22 provides a significant amount of flexibility for installers and users to arrange comestible fluid dispensing components 48 as desired on the rail 22. In this regard, the rail and bracket system described above provides a number of advantages when employed on the rack 10 illustrated in FIGS. 1, 2A, and 5, but provides similar advantages when employed in other locations, such as to a wall, a frame, shelving, or in any other location. Accordingly, the rail and bracket system described above and illustrated in FIGS. 3 and 4 can be used in any other location desired, and need not necessarily be employed in a comestible fluid container rack 10 as shown in FIG. 5.

Figure 6:
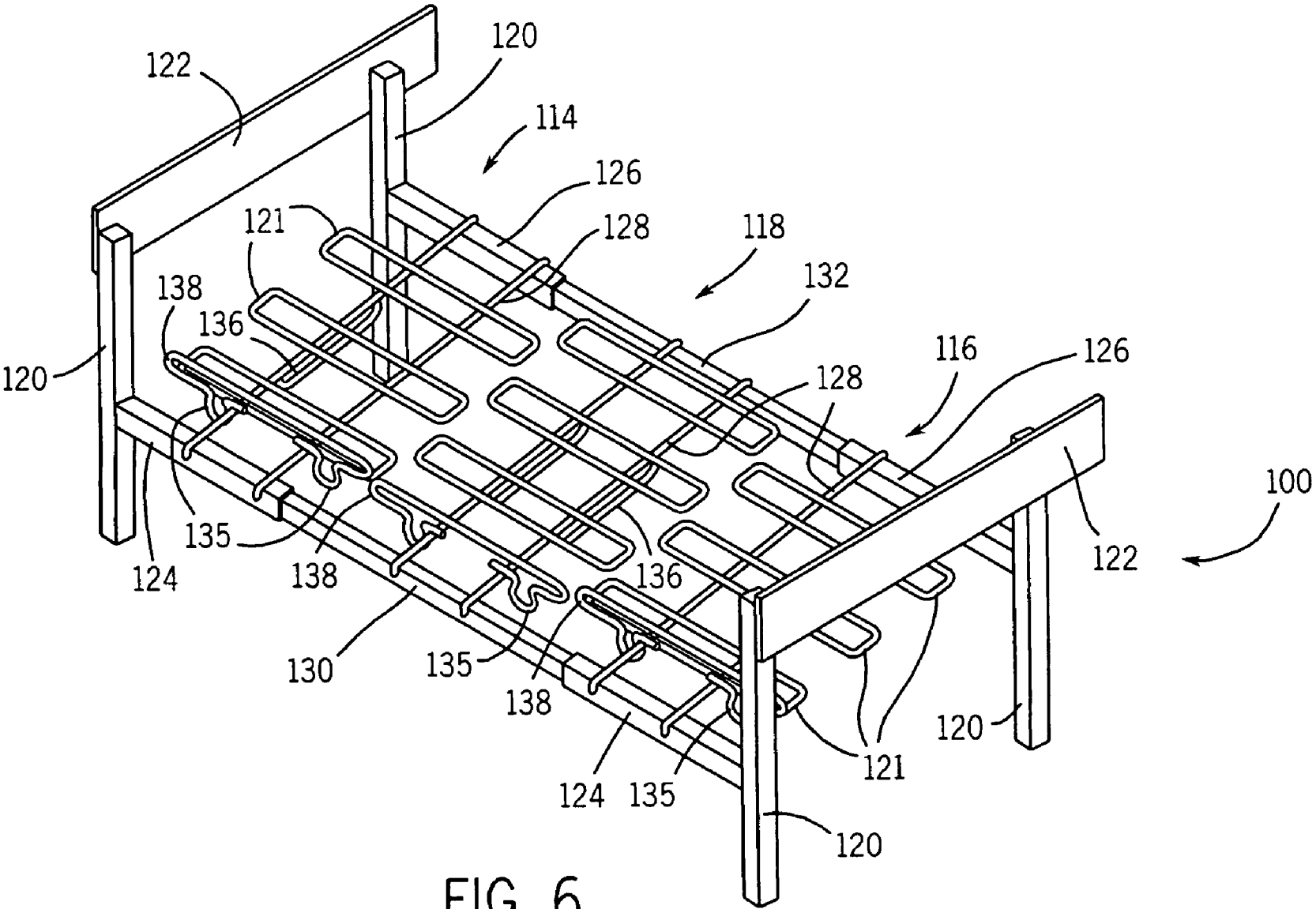
FIG. 6 is a perspective view of a rack according to another embodiment of the present invention, wherein the rack is shown in a lengthened configuration.
Figure 7:
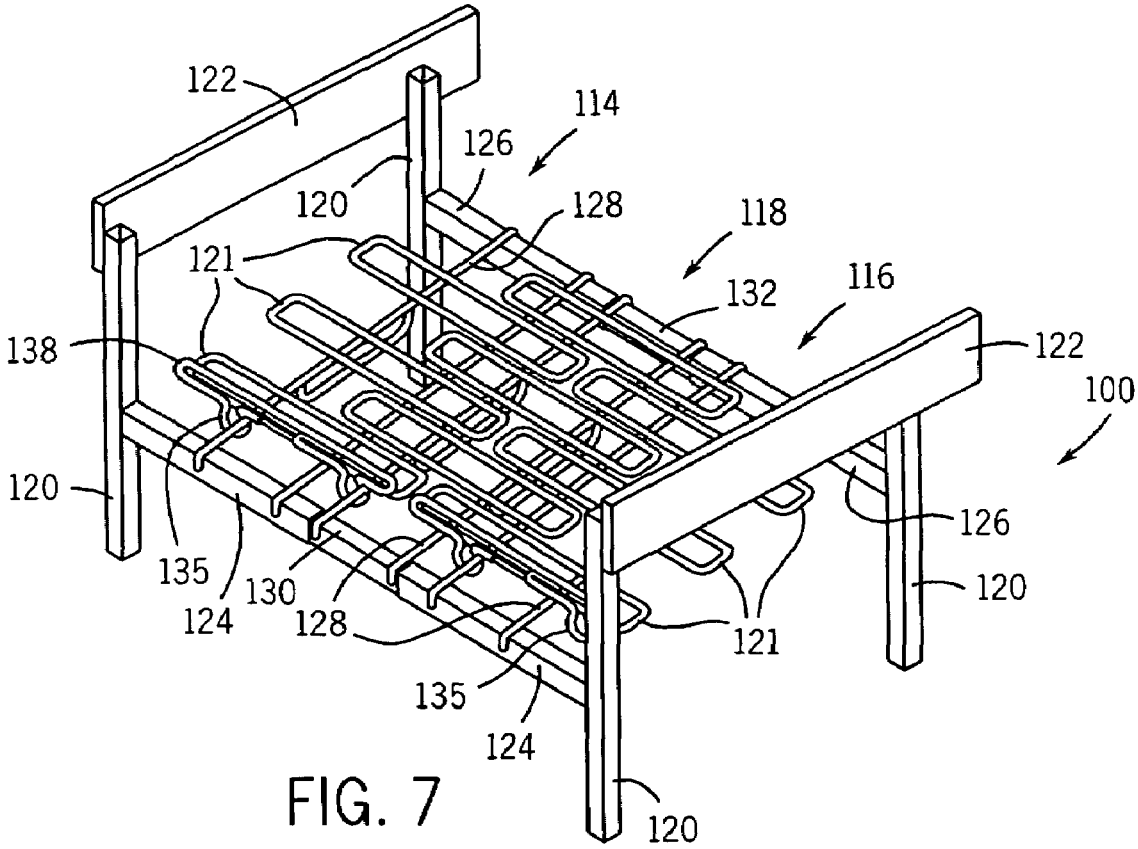
FIG. 7 is another perspective view of the rack of FIG. 6, wherein the rack is shown in a shortened configuration.
Figure 8:
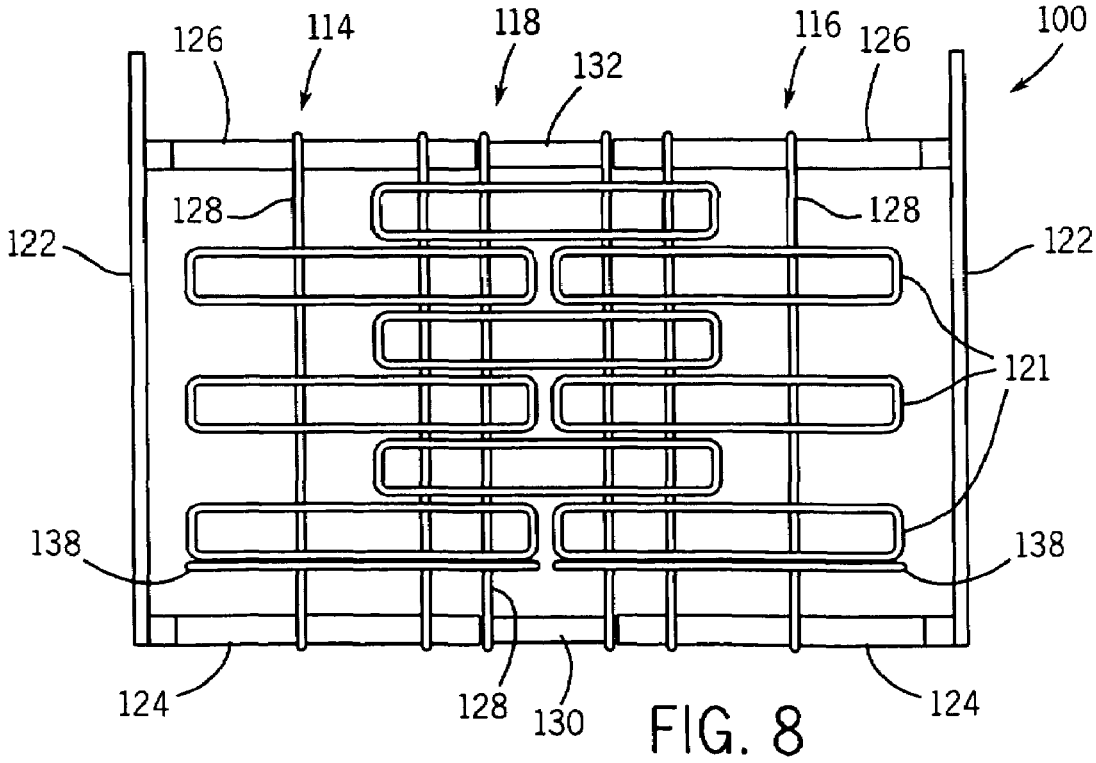
FIG. 8 is a top view of the rack shown of FIGS. 6 and 7, shown in a shortened configuration.

FIGS. 6-8 illustrate another exemplary embodiment of a comestible fluid rack 100 according to the present invention. The rack 100 is substantially similar to the rack 10 shown in FIGS. 1-5, with like elements labeled with like reference numerals in the 100 series of reference numbers. With the exception of mutual inconsistencies in the racks 10, 100, reference is hereby made to the description above relating to the rack embodiment of FIGS. 1-5 for further description of the various features and elements of the rack 100 illustrated in FIGS. 6-8 and described below (as well as the alternatives to such features and elements).

The exemplary rack 100 illustrated in FIGS. 6-8 includes two end portions 114, 116, each having a support 128, and a center portion 118 having another support 128. Each support 128 includes at least one wing or other extension 121 coupled, although fewer than all of the supports 128 can have such extensions 121, if desired. In some embodiments, some or all of the extensions 121 can extend laterally from their respective supports 128, such as in a direction substantially perpendicular to the rest of the support 128 as shown in FIGS. 6-8 or at another angle with respect thereto. In the illustrated construction, each extension 121 is positioned generally on top of the remainder of the support 128, such that comestible fluid containers can be supported on top of the extensions 121 rather than on top of the support portions extending toward the stretchers 124, 126, 130, 132. However, in other embodiments, the extension 121 can be located below the rest of the support 128 or can lie generally in the same plane as the rest of the support 128 for any desired amount of direct contact with a comestible fluid container thereon.

In some constructions of the rack 100, the support 128 and the extension(s) 121 of the support can be separate components made of the same or different material. By way of example only, the extension(s) 121 can be made of metal wire joined in any of a number of different ways (e.g., welding, brazing, bonding, fastening, etc.) to the rest of the support 128, can be made of fiberglass, plastic, composite, or other material joined to the rest of the support 128 by adhesive or cohesive bonding material, fasteners, etc., or can be made of any other material desired. In other constructions, the support 128 can be integral with one or more extensions 121, such that a first portion of the support 128 extends between stretchers 124, 126 or 130, 132 and one or more extensions 121 of the support 128 extend substantially laterally from the first portion to support one or more comestible fluid containers thereon. Each support 128 in the exemplary embodiment of FIGS. 6-8 has three extensions 121 coupled thereto and extending laterally to both sides of a center support portion. In other embodiments, however, the supports 128 can have fewer or more extensions 121 extending to either or both sides of a central support portion.

In those embodiments of the present invention in which one or more supports 128 having one or more extensions 121 are employed, the extensions 121 can be located anywhere along the supports 128 desired (such as at the front, middle, and/or rear of each support 128) and can be arranged on the supports 128 in any manner desired (such extensions 121 that are equally spaced along the supports 128, or extensions 121 arranged in other manners). In some embodiments, the arrangement of extensions 121 on the supports 128 help to define desired relationships between adjacent supports as will now be described.

In the illustrated construction of the rack 100 in FIGS. 6-8, the extensions 121 on a center support 128 of the rack 100 (e.g., on the center portion 118 of the rack 100) are offset with respect to the extensions 121 of adjacent supports 128 (e.g., on the end portions 114, 116 of the rack 100). In other words, extensions 121 of adjacent supports 128 on the rack 100 are located in different positions along the lengths of the supports 128. Such a relationship between adjacent supports 128 allows the extensions 121 to nest within one another in an overlapping or non-overlapping manner.

For example, when the stretchers 124, 126, 130, 132 are telescoped with respect to one another in order to lengthen or shorten the rack 100 as described in greater detail below, one or more extensions 121 of a support 128 can be received in a nested configuration with respect to one or more extensions 121 of an adjacent support 128. In the illustrated exemplary embodiment in which each support 128 has three extensions 121, two extensions 121 of each support 128 can each be received between a pair of extensions 121 of an adjacent support 128, while one extension 121 of each support 128 is received adjacent an extension 121 at the end of an adjacent support 128. In other embodiments, any number (i.e., one or more) of extensions 121 of a support 128 can be nested with respect to any number (i.e., one or more) of extensions 121 of an adjacent support 128. As used herein and in the appended claims, the term "nested" means a relationship in which an extension 121 of one support 128 is received between two extensions 121 of an adjacent support 128 or has a length that can be positioned alongside a length of at least one extension 121 on an adjacent support 128. In some embodiments, any number of extensions 121 on a first support 128 can be nested with respect to any number of extensions 121 on supports 128 located to either or both sides of the first support 128, and can be nested to any degree desired. Such nesting can be accomplished by the use of telescoping stretchers 124, 126, 130, 132 as described above, by moving supports 128 along telescoping or non-telescoping stretchers 124, 126, 130, 132 in any other manner (as also described above), or by placing and/or securing supports 128 on the rack 100 in such a manner.

In addition to or as an alternative to nesting extensions 121 of adjacent supports 128 on a rack 100, one or more extensions 121 on a support 128 can be positioned to overlap one or more adjacent supports 121. By way of example only, in some telescoping positions of the exemplary rack 100 illustrated in FIGS. 6-8, the extensions 121 of a support 128 overlap the center portion of at least one adjacent support 128. As another example, in some embodiments one or more extensions 121 of a support 128 can overlap one or more extensions of an adjacent support 128. Any number of extensions 121 can overlap any portion(s) of one or more adjacent supports 128 to any degree and amount desired. In some embodiments, the degree and amount of overlap can vary depending upon the positions of adjacent supports 128 (whether adjustable in any manner described above or otherwise). In the illustrated exemplary embodiment, the extensions 121 of each support 128 can overlap adjacent supports 128 to a greater or lesser extent based upon the telescoping positions of the stretchers 124, 126, 130, 132.

It should be noted that the extension(s) 121 of a support 128 can be positioned on either side of another support 128 (e.g., on an upper or lower side of another support 128). As used herein and in the appended claims, the terms "overlapping" and "overlap" refer to both positions of an extension 121 (or other support portion) with respect to another support.

In some embodiments, one or more supports 128 of the rack 100 can be positioned to nest with and overlap adjacent supports 128 (see, for example, the illustrated exemplary embodiment of FIGS. 6-8. Either capability can permit the rack 100 to be shortened or lengthened as desired while still providing a relatively wide base upon which comestible fluid containers can be supported. As best shown in FIGS. 7 and 8, the extensions 121 of the support 128 on the left end portion 114 can nest with extensions 121 of the support 128 on the center portion 118, while the extensions 121 of the support 128 on the center portion 118 can nest with extensions 121 of the support 128 on the left end portion 114. Alternatively or in addition, a similar relationship can exist between the extensions 121 and supports 128 of the center and right end portions 118, 116 depending at least in part upon the telescoping positions of the stretchers 124, 126, 130, 132. Also, the extensions 121 of the support 128 on the left end portion 114 can overlap the support 128 on the center portion 118, while the extensions 121 of the support 128 on the center portion 118 can overlap the support 128 on the left end portion 114 when the rack 100 is in a shortened configuration. Alternatively or in addition, a similar relationship can exist between the extensions 121 and supports 128 on the center and right end portions 118, 116 depending at least in part upon the telescoping positions of the stretchers 124, 126, 130, 132. The extensions 121 can overlap adjacent supports 128 by virtue of being located on top of the center portions of the supports 128, such that telescoping movement of the stretchers 124, 126, 130, 132 is not affected by an extension 121 overlapping an adjacent support 128.

With reference to FIGS. 6 and 7, some embodiments of the present invention provide a stop 138 for one or more of the supports 128 on the rack 100. The stop 138, as previously described with reference to the stops 38 of FIGS. 1, 2A, and 5, can be positioned toward a lower portion of each support 128 such that the stop 138 maintains a comestible fluid container on the rack 100 when the support 128 is tilted with respect to a horizontal plane. The stop 138 can extend from the support 128 in a vertical direction or can be tilted at an angle with respect to a vertical direction while still performing this stopping function. Also, the stop 138 can extend laterally from the support 128, if desired. In some embodiments, the stop 138 can therefore be defined as another extension 121 oriented as just described to stop a comestible fluid container from sliding off the rack 100. In such embodiments, the stop 138 can nest and overlap other stops 138 and/or extensions 121 in a manner described above with reference to the earlier-described extensions 121 of the supports 128. As shown in FIGS. 7 and 8 for example, when the rack 100 is in a shortened configuration, the stops 138 can provide a barrier to any number of comestible fluid containers supported on the extensions 121. In some embodiments, this barrier can be gapless or can otherwise have no gaps sufficiently large to permit a comestible fluid container to fall from the rack 100.

In some embodiments, the stop 138 (if employed) can be integral with the support 128, such as a stop 138 formed from the same wire material as the center portion of the support 128 in the exemplary embodiments of FIGS. 6-8. However, in other embodiments, the stop 138 can be a separate component that is part of the support 128, or can be another component that is not part of the support 128. In such cases, the stop 138 can be permanently or releasably joined to the support 128 in any manner (e.g., welding, brazing, bonding, snap-fit, clipped, fastened, etc.). In the illustrated embodiment of FIGS. 6-8 for example, the stops 138 are separate components made from metal wire, and are welded to the supports 128.

With reference to FIG. 6, in some embodiments one or more of the stops 138 can include one or more conduit supports 135 shaped to receive therethrough conduits (64, see FIG. 5) fluidly connected to the comestible fluid containers. The conduit supports 135 can be utilized to support conduits 64 toward the inlet ends of the conduit 64 where the conduits 64 can be fluidly connected to the comestible fluid containers. In the illustrated construction of the stops 138, the conduit supports 135 are circular, and are integral with the stops 138. However, in alternate constructions, the conduit supports 135 can have any other shape capable of receiving and otherwise supporting conduit 64, and need not necessarily be integral with the stops 138 (e.g., conduit supports 135 connected to the stops 138 in any of the manners described above with reference to the relationship between the conduit braces 34 and the supports 28 in the exemplary embodiment of FIGS. 1-5). Also, alternate constructions of the stops 138 can employ more or less than two conduit supports 135 as shown in FIGS. 6-8. The conduit supports 135 can also be employed in addition to or separate from the elongated loops 36 described above.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the rack 10 illustrated in FIGS. 1, 2A, and 5 and the rack 100 illustrated in FIGS. 6-8 are adapted to support bag-in-box type comestible fluid containers. However, the rack 10, 100 of the present invention can be employed to support other types of comestible fluid containers. In such cases, the supports 28, 128 (if employed) can be adapted to support such other types of comestible fluid containers. In the case of comestible fluids stored in bags for example, the supports 28, 128 can take the form of hangers suitable for suspending bags of comestible fluid. In the case of kegs stored on their sides as another example, the supports 28, 128 can be wider and/or can be shaped to cradle the kegs. In short, the rack 10, 100 can be adapted to hold any type of comestible fluid container desired, can have supports 28, 128 shaped to support different comestible fluid container types, and can be provided with additional supporting elements as needed for supporting the comestible fluid containers.

We claim:

1. A bracket for mounting a pump to a rail of a comestible fluid container rack, the rail including at least one groove, the pump including a first portion, a first aperture, and a second portion, the bracket comprising:

a substantially planar body including at least one edge that is adapted to slide along the at least one groove of the rail;

a lever, at least one finger, and at least one boss coupled to the substantially planar body;

the lever including a second aperture adapted to contact the first portion of the pump;

at least one finger adapted to be received by the first aperture of the pump; and the at least one boss adapted to contact the second portion of the pump.

2. The bracket of claim 1, wherein the at least one edge of the substantially planar body is beveled.

3. The bracket of claim 1, wherein the lever is adapted to snap onto the pump, and wherein the lever is pressed to release the pump.

4. The bracket of claim 1, wherein the lever is integral with the substantially planar body.

5. The bracket of claim 1, wherein the at least one finger includes two fingers integrally coupled to one edge of the substantially planar body.

6. The bracket of claim 1, wherein the at least one boss includes two bosses raised from the substantially planar body, the two bosses spaced to frictionally secure the pump.

7. The bracket of claim 1, wherein the second portion is a flat surface.

* * * * *